United States Patent [19]

Hübner et al.

[11] 4,344,012

[45] Aug. 10, 1982

[54] ANODE DISC FOR A ROTARY-ANODE X-RAY TUBE

[76] Inventors: Horst Hübner, Kesselstrasse 40; Bernhard Lersmacher, Schlossweiherstrasse 31, both of 5100 Aachen; Hans Lydtin, Am Goepelschacht 9, 5190 Stolberg; Rolf Wilden, Brandstrasse 56, 5106 Roetgen, all of Fed. Rep. of Germany

[21] Appl. No.: 129,501

[22] Filed: Mar. 11, 1980

[30] Foreign Application Priority Data

Mar. 15, 1979 [DE] Fed. Rep. of Germany ..... 2910138

[51] Int. Cl.[3] ..... H01J 35/04

[52] U.S. Cl. ..... 313/60; 313/311

[58] Field of Search ..... 313/60, 39, 40, 330, 313/311; 428/408

[56] References Cited

U.S. PATENT DOCUMENTS

| | | | |
|---|---|---|---|
| 3,942,059 | 3/1976 | Tran-Quang | 313/60 |
| 4,037,127 | 7/1977 | Kawai et al. | 313/60 |
| 4,227,112 | 10/1980 | Waugh et al. | 313/60 X |
| 4,271,372 | 6/1981 | Geldner et al. | 313/60 X |

*Primary Examiner*—Davis L. Willis

*Attorney, Agent, or Firm*—Robert J. Kraus

[57] ABSTRACT

The focal path (4) of an anode disc in accordance with the invention is provided on a pyrographite ring (1) which is oriented so that the surfaces of higher thermal and electrical conductivity extend parallel to the axis of rotation (3) of the anode disc. As a result, suitable removal of heat can be ensured without thermal overloading of the bearings.

11 Claims, 2 Drawing Figures

ANODE DISC FOR A ROTARY-ANODE X-RAY TUBE

BACKGROUND OF THE INVENTION

The invention relates to an anode disc for a rotary-anode X-ray tube, comprising a supporting body which can be connected to a shaft and which is connected to a ring of pyrographite which is concentric with an axis about which the disc is adapted to be rotated in operation and whose surfaces of higher thermal conductivity extend at least approximately perpendicularly with respect to the focal path connected thereto.

An anode disc of this kind is known from German Offenlegungsschrift 24 40 988. Therein, the graphite supporting body of the anode disc comprises a groove in which the pyrographite ring is inserted. The heat developed in the focal path provided on the outer edge of the pyrographite ring is dissipated better by this pyrographite ring than if the anode body were to consist exclusively of (electro) graphite.

Heat developed in the focal path is then conducted inwards towards the axis of the supporting body, because the surfaces of higher thermal and electrical conductivity which extend perpendicularly to the growth direction of the pyrographite are situated perpendicularly to the axis of the graphite body of the rotary anode. Consequently, the bearings of the shaft whereto the anode disc is connected inside an X-ray tube are liable to be thermally overloaded.

SUMMARY OF THE INVENTION

The present invention has for its object to construct an anode disc of the described kind so that on the one hand the heat developed in the focal spot can be suitably dissipated, while on the other hand in the operation of an X-ray tube which contains the anode disc mounted on a shaft, the bearings of the shaft are not thermally overloaded.

According to the invention an anode disc as set forth in the opening paragraph is characterized in that the surfaces of higher thermal and electrical conductivity extend parallel to the axis of rotation. Thus, fast conduction of the heat from the focal path is always ensured, the heat flow being towards at least one of the major surfaces of the anode disc, and not only towards the axis of rotation as in the device described in German Offenlegungsschrift No. 24 40 988, so that the heat is on the one hand suitably dissipated while on the other hand the bearings are not thermally overloaded.

Preferably, use is made of pyrographite obtained by separation from the gaseous phase at low pyrolysis gas pressures ($p \approx 1.33$ to 13.3 mbar) and high separation temperatures ($\approx 2000°$ C.), for example, see U.S. Pat. No. 3,692,565 or "Philips Technische Rundschau" 1977/78, No. 8, page 205 et seq., or "Chemie-Ingenieur-Technik", 39th Edition, Chapter 14 (1967), pages 833–842. The graphite described in German Offenlegungsschrift No. 24 40 988, however, is a recrystallized, i.e. thermally treated form.

The surfaces of higher thermal conductivity extend parallel to the axis of rotation, i.e. they either concentrically enclose the axis of rotation or are situated in planes which extend at least approximately radially. When in the latter case the pyrographite ring is inserted in a groove in the supporting body, the heat developed in the focal path flows through three sides of the ring into the supporting body, and the bearing is not overloaded, because the heat can then be stored in and radiated from the supporting body. However, if the pyrographite ring is instead connected to the supporting body only by way of its inner edge, two sides of the ring are free for radiating heat developed in the focal path.

When the surfaces of higher thermal conductivity extend radially, the focal path can also be provided on the circumferential surface of the pyrographite ring. However, the metal of the focal path should then keep together the pyrographite ring which should in this case consist of sector-shaped parts; this may be problematic.

It is less problematic when the focal path is provided on an axial face of the ring.

When the surfaces of higher thermal conductivity of the pyrographite ring are situated in planes extending radially with respect to the axis of rotation, the heat from the focal spot is partially conducted to the major surface of the anode disc which is remote from the focal path, and partially toward the axis of rotation of the anode disc. The part of the heat conducted towards the axis of rotation of the anode disc, which part could lead to thermal overloading of the bearings, can be reduced in an embodiment of the invention in that the surfaces of higher thermal conductivity of the sector-like parts extend at least approximately towards the axis of rotation and in that between the inner edge of the ring and the supporting body there is provided a further ring, the thermal conductivity of which is substantially lower in the radial direction than that of the said pyrographite ring.

BRIEF DESCRIPTION OF THE DRAWING

Embodiments of the invention will be described in detail hereinafter, by way of example with reference to the accompanying diagrammatic drawings, in which.

DESCRIPTION OF THE PREFERRED EMBODIMENTS

Figure 1:
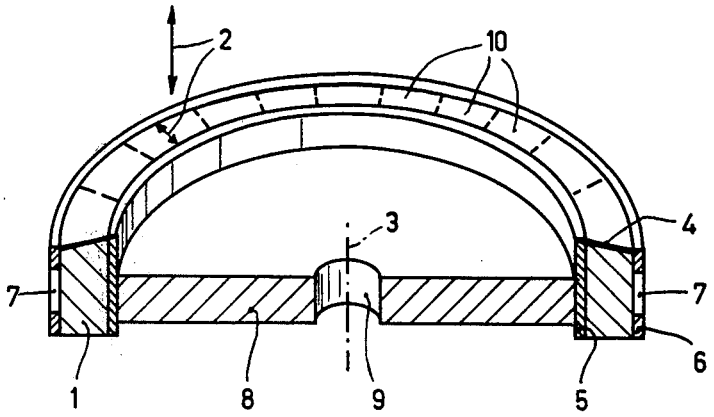
FIG. 1 shows a first embodiment.

The pyrographite ring of the anode disc shown in FIG. 1 is denoted by the reference numeral 1. As is indicated by the arrows 2, the highest thermal conductivity of the pyrographite ring occurs in the radial direction and in the axial direction. In practice it is very difficult to construct a ring of this kind as one unit. Therefore, as is denoted by broken lines, it consists of a number of segments 10, the adjoining side faces of which extend approximately radially and whose radially inner and outer faces are concentrically curved with respect to the axis 3 of the anode disc. These segments can be made, by sawing and/or grinding, from pyrographite bodies, the direction of growth of which extends perpendicularly to the side faces (denoted by broken lines) of the segments 10. The upper end face (i.e. axial face) of the pyrographite ring 1 which faces the cathode when the anode disc is incorporated in an X-ray tube is provided with a layer 4, forming a focal path, of a material having a high atomic number and a high thermal resistance, preferably a layer of tungsten or a tungsten alloy. This layer can be deposited either by separation from the gaseous face on the bevelled end face of the pyrographite ring, in which case it is comparatively thin, or by soldering of a thicker layer, with the aid of zirconium, for example, as described in German Patent Specification No. 21 15 896.

In order to prevent the heat which is developed in the focal path 4 from flowing inwards from the ring towards the axis 3 (the ring 1 exhibits high thermal conductivity in this direction as a result of the disposition of the surfaces of higher conductivity, denoted by the arrows 2) there is provided inside the ring 1 a further ring 5 which serves as a heat trap and which has a substantially lower thermal conductivity, at least towards the axis 3. To this end, the ring 5 may also be made of pyrographite, but in that case the surfaces of higher conductivity should extend concentrically with respect to the axis 3. A ring of this kind can be obtained by deposition of a gas containing carbon on a suitably shaped mandrel, resulting in radial growth. In order to obtain adequate mechanical strength, the outer edge of the pyrographite ring 1 is enclosed by a further pyrographite ring 6 which has a thickness of one or more millimeters and whose surfaces of higher thermal conductivity also extend concentrically with respect to the axis 3 of the anode disc. The rings 5 and 6 can be formed simultaneously and directly by separation from a gas containing carbon onto the pyrographite ring 1. However, the (axial) end faces of the ring 1 are then also covered with a pyrograhite layer. These layers on the end faces of the ring impede the removal of heat and should, therefore, be removed by grinding.

In order that the heat taken up by the pyrographite ring 1 from the focal path can be dissipated to the environment by the outer ring 6 which has a low thermal conductivity in the radial direction, the outer ring 6 comprises apertures 7 which are uniformly distributed around its circumference and wherethrough the radially outer surface of the pyrographite ring 1 can discharge heat by radiation.

The outer diameter of the pyrographite ring 4 may be from 80 to 300 mm, preferably 120 mm, its thickness from 10 to 40 mm, preferably 20 mm, and its height (i.e. axial length) from 10 to 40 mm, preferably 20 mm. The pyrographite ring conducts the heat developed in the focal path 4 to its lower (axial) end face where it can be dissipated by radiation, and to its radially outer face where it is also dissipated by radiation. When use is made of such a ring 1, the thermal conductivity and the thermal capacity of a supporting body 8, which connects the ring to a shaft which is not shown in FIG. 1 and which extends through a bore 9 in the supporting body, do not have to satisfy very severe requirements, provided that its electrical conductivity is adequate. Therefore, the supporting body may consist of normal, porous or microporous vitreous carbon, carbon foam with carbide-forming and non-carbide-forming metals, impregnated carbon foam, fibre-reinforced boron nitride, or of a light metal such as titanium.

The supporting body 8 is connected to the inner surface of the inner ring 5 by suitable means, such as clamps, screws, soldering or welding. Soldering can be realized in known manner by using, for example, a zirconium soldering material. When suitable steps are taken, for example, by using a supporting body in the form of a spoked wheel or two supporting bodies of the same dimensions which are offset in the axial direction, the anode disc can be mechanically stabilized in the case of large disc diameters.

Instead of using a ring 1 which is composed of segments, use can be made of an integral pyrographite ring whose surfaces of higher thermal conductivity concentrically surround the axis 3. The outer rings 5 and 6 can then be omitted. A ring of this kind can be realized by separation from a gas containing carbon onto a cylindrical mandrel. However, the heat will then be conducted from the focal path only downwards and not outwards.

Figure 2:
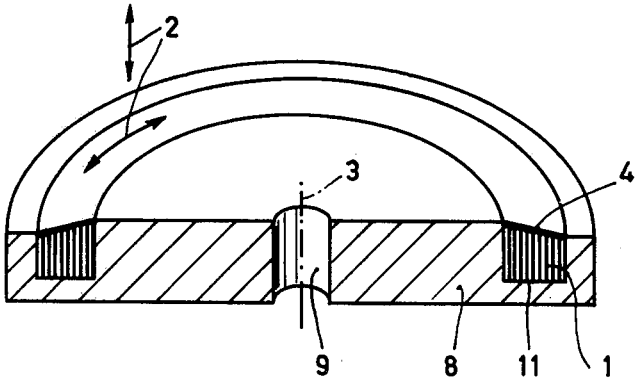
FIG. 2 a second embodiment of the invention.

Using the same reference numerals as FIG. 1 for corresponding parts, FIG. 2 shows an anode disc whose supporting body 8 comprises a groove 11 having an approximately rectangular cross-section in which the pyrographite ring 1 is arranged. As is denoted by the arrows 2, the surfaces of higher conductivity extend concentrically about the axis 3 and axially. The pyrographite layers thus form hollow cylindrical surfaces which are concentric with the disc axis 3. The focal path 4 can be deposited on the bevelled axial end face of the pyrographite ring in the manner described with reference to FIG. 1. The connection between the pyrographite ring 1 and the supporting body 8 in the groove 11 can be realized using the described techniques. Instead of an integral pyrographite ring, use can be made of a ring consisting of many segments too and these segments can be arranged in the groove 11 either so that their planes of higher conductivity extend in the radial direction or again concentrically enclose the axis 3. In the former case a heat trap is required between the supporting body and the radially inner edge of the pyrographite ring 1 in order to prevent the heat from being conducted radially inwards from the pyrographite ring.

What is claimed is:

1. An anode disc for a rotary-anode X-ray tube, comprising a supporting body connected to a ring of pyrographite which is concentric with an axis about which the disc is rotated in operation, said ring having a surface forming a focal path and surfaces of higher and lower thermal conductivity, characterized in that the surfaces of higher thermal conductivity extend parallel to the axis of rotation.

2. An anode disc as in claim 1, characterized in that the focal path is transverse to the axis of rotation.

3. An anode disc as in claim 1 characterized in that the pyrographite ring surrounds the supporting body.

4. An anode disc as in claim 1, characterized in that the supporting body includes a groove which is concentric to the axis of rotation, the ring being inserted in this groove.

5. An anode disc as in claim 3 or 4, characterized in that the pyrographite ring is an integral unit, the surfaces of higher thermal conductivity of the ring concentrically enclosing the axis of rotation.

6. An anode disc as in claim 3 or 4, characterized in that the ring comprises individual segments of pyrographite.

7. An anode disc as in claim 6 and further including a heat trapping ring whose thermal conductivity in the radial direction is substantially lower than that of the pyrographite ring, said heat trapping ring being arranged between the inner diameter of the pyrographite ring and the supporting body.

8. An anode disc as in claim 7, characterized in that the heat trapping ring consists of pyrographite and has surfaces of higher and lower thermal conductivity, the surfaces of higher thermal conductivity extending concentrically about the axis of rotation.

9. An anode disc as in claim 6 and further including an outer ring surrounding the segmented ring.

10. An anode disc as in claim 9, characterized in that the outer ring includes apertures on its radially outer side.

11. A rotary-anode X-ray tube comprising an anode disc as in claim 1, 2, 3 or 4.

* * * * *